US011154107B2

(12) United States Patent
Isobe

(10) Patent No.: US 11,154,107 B2
(45) Date of Patent: Oct. 26, 2021

(54) VISOR LOCKING MECHANISM AND HELMET

(71) Applicant: SHOEI CO., LTD., Tokyo (JP)

(72) Inventor: Eiji Isobe, Tokyo (JP)

(73) Assignee: SHOEI CO., LTD., Tokyo (JP)

( * ) Notice: Subject to any disclaimer, the term of this patent is extended or adjusted under 35 U.S.C. 154(b) by 294 days.

(21) Appl. No.: 16/352,968

(22) Filed: Mar. 14, 2019

(65) Prior Publication Data

US 2020/0253316 A1 Aug. 13, 2020

(30) Foreign Application Priority Data

Feb. 8, 2019 (JP) ..... JP2019-021815

(51) Int. Cl.
*A42B 3/22* (2006.01)

(52) U.S. Cl.
CPC ..... *A42B 3/223* (2013.01)

(58) Field of Classification Search
CPC ..... A42B 3/223; A42B 3/226; A42B 3/222
USPC ..... 2/424, 6.4, 6.5
See application file for complete search history.

(56) References Cited

U.S. PATENT DOCUMENTS 3,473,166 A * 10/1969 Marcel ..... A42B 3/222 2/6.5
4,907,300 A * 3/1990 Dampney ..... A42B 3/228 2/424
5,073,990 A * 12/1991 Kamata ..... A42B 3/222 2/424
5,165,117 A * 11/1992 Kamata ..... A42B 3/223 2/424
5,182,816 A * 2/1993 Arai ..... A42B 3/222 2/424
5,185,889 A * 2/1993 Kamata ..... A42B 3/222 2/424
5,444,875 A * 8/1995 Taniuchi ..... A42B 3/326 2/424
6,161,225 A * 12/2000 Arai ..... A42B 3/226 2/424
6,226,803 B1 * 5/2001 Tanaka ..... A42B 3/326 2/424

(Continued)

FOREIGN PATENT DOCUMENTS

EP 2 550 884 A1 1/2013
JP 2013-28872 A 2/2013

OTHER PUBLICATIONS

European Search Report for EP 19171969.9-1017, dated Oct. 29, 2019, pp. 1-4.

(Continued)

*Primary Examiner* — Heather Mangine
(74) *Attorney, Agent, or Firm* — Thomas|Horstemeyer, LLP

(57) ABSTRACT

A visor locking mechanism is applied to a helmet equipped with a visor. The visor is provided on an inner side of an outer shell of the helmet which has a facial opening in a front side thereof. The visor is attached to a pair of left and right holders which are pivotably attached to the outer shell. The visor is configured to close or open at least part of the facial opening. A lock member that has an operation portion and a catch portion is disposed near at least one of the pair of holders. The operation portion allows the catch portion to fit together with or disengage from a catch counterpart portion provided at the pair of holders, whereby the visor becomes anchored or released.

2 Claims, 6 Drawing Sheets

(56) References Cited

U.S. PATENT DOCUMENTS

| | | | | |
|---|---|---|---|---|
| 6,301,721 | B1 * | 10/2001 | Arai | A42B 3/222 2/424 |
| 6,442,766 | B1 * | 9/2002 | Arai | A42B 3/222 2/422 |
| 2002/0138897 | A1 * | 10/2002 | Arai | A42B 3/222 2/424 |
| 2002/0189005 | A1 * | 12/2002 | Taniuchi | A42B 3/223 2/424 |
| 2009/0038057 | A1 * | 2/2009 | Tews | A42B 3/24 2/424 |
| 2010/0005558 | A1 * | 1/2010 | Lee | A42B 3/223 2/15 |
| 2010/0050326 | A1 * | 3/2010 | Lee | A42B 3/222 2/422 |
| 2010/0064406 | A1 * | 3/2010 | Lee | A42B 3/226 2/10 |
| 2011/0094019 | A1 * | 4/2011 | Isobe | A42B 3/222 2/424 |
| 2013/0025015 | A1 * | 1/2013 | Isobe | A42B 3/222 2/10 |
| 2013/0031699 | A1 * | 2/2013 | Gafforio | A42B 3/226 2/411 |
| 2013/0191976 | A1 * | 8/2013 | Pizzi | A42B 3/223 2/424 |
| 2014/0352020 | A1 * | 12/2014 | Isobe | A42B 3/223 2/9 |
| 2015/0059069 | A1 * | 3/2015 | Arai | A42B 3/222 2/424 |

OTHER PUBLICATIONS

European Examination Report for EP 19171969.9-1017, dated Nov. 6, 2019, pp. 1-4.

* cited by examiner

VISOR LOCKING MECHANISM AND HELMET

CROSS-REFERENCE TO RELATED APPLICATION

This application is based on and claims priority under 35 USC 119 from Japanese Patent Application No. 2019-021815 filed on Feb. 8, 2019, the disclosure of which is incorporated by reference herein.

BACKGROUND

Technical Field

This disclosure relates to a visor locking mechanism and a helmet. In particular, this disclosure relates to a helmet that has a facial opening formed in a front surface thereof and to a locking mechanism for a visor that is attached to the helmet in such a way that the visor can pivot up and down with respect to the helmet to at least partially open and close the facial opening, wherein a hook provided on a visor holder fits together with a latch connected to an operation lever to thereby arrest the pivoting of the visor and anchor the visor.

Related Art

Japanese Patent Application Laid-open (JP-A) No. 2013-28872 discloses a helmet that has a visor. In this helmet, both end portions of the visor are held by a pair of left and right holders. Furthermore, one end of a movable wire is connected to the holders and the other end is connected to a sliding knob, so that by sliding the knob the holders are pivoted along fixed rails.

SUMMARY

However, in the configuration disclosed in JP-A No. 2013-28872, the wire freely extends and contracts, so the visor can be taken in hand and moved even without operating the knob. For this reason, the holders move unintentionally even if one tries to stop the holders in predetermined positions (in a state in which the visor is lowered) when detaching or when attaching the visor, so the work of detaching or attaching the visor has been difficult.

This disclosure provides a visor locking mechanism and a helmet that can facilitate the work of detaching or attaching the visor.

A visor locking mechanism of this disclosure is applied to a helmet equipped with a visor, the visor being provided on an inner side of an outer shell of the helmet which has a facial opening in a front side thereof, the visor being attached to a pair of left and right holders which are pivotably attached to the outer shell, and the visor being configured to close or open at least part of the facial opening, the visor locking mechanism comprises a lock member, the lock member having an operation portion and a catch portion, the lock member being disposed near at least one of the pair of holders, and the operation portion allowing the catch portion to fit together with or disengage from a catch counterpart portion provided at the pair of holders, whereby the visor becomes anchored or released.

A helmet of this disclosure includes an outer shell which has a facial opening in a front side thereof, a visor being provided on an inner side of the outer shell of the helmet, the visor being attached to a pair of left and right holders which are pivotably attached to the outer shell, and the visor being configured to close or open at least part of the facial opening; and the visor locking mechanism that is provided on at least one of the a pair of left and right sides of the outer shell.

The visor locking mechanism and the helmet pertaining to this disclosure have the superior effect of being able to facilitate the work of detaching or attaching the visor.

BRIEF DESCRIPTION OF THE DRAWINGS

An exemplary embodiment of this disclosure will be described in detail based on the following figures, wherein.

DETAILED DESCRIPTION

An embodiment in which a visor locking mechanism of this disclosure is applied to a full-face helmet will now be described with reference to the drawings under the section headings "1. General Configuration of Helmet Overall" and "2. Configuration of Visor Locking Mechanism."

1. General Configuration of Helmet Overall

Figure 1:
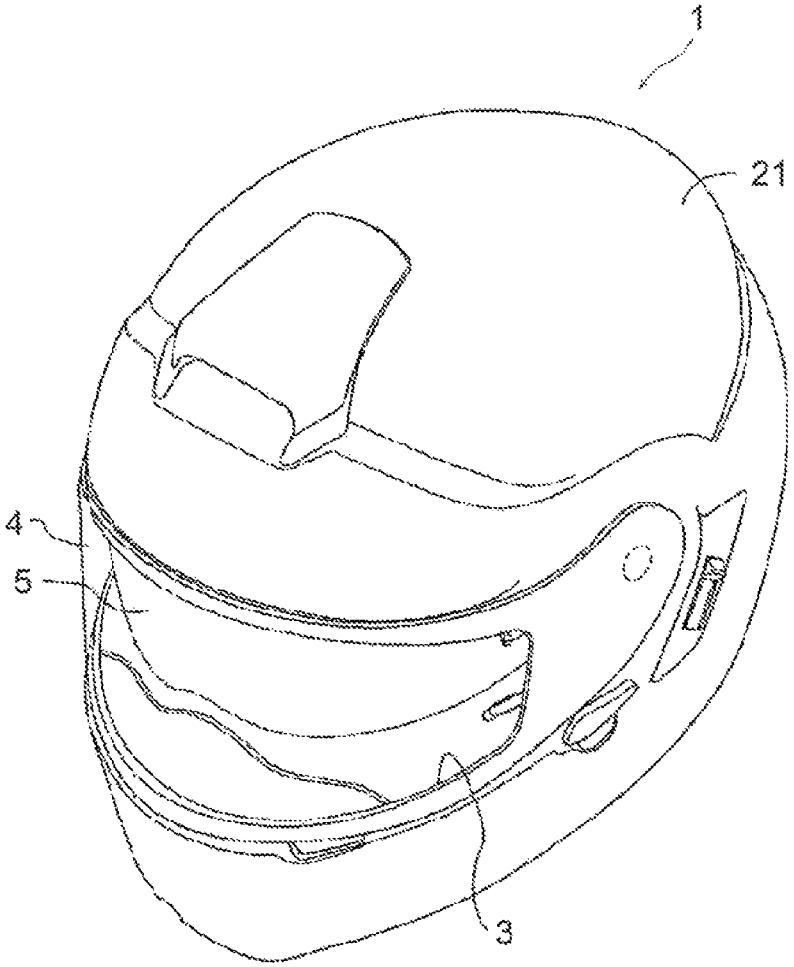
FIG. 1 is a perspective view showing a helmet equipped with a visor locking mechanism of this disclosure and shows a state in which the visor is lowered.
Figure 2:
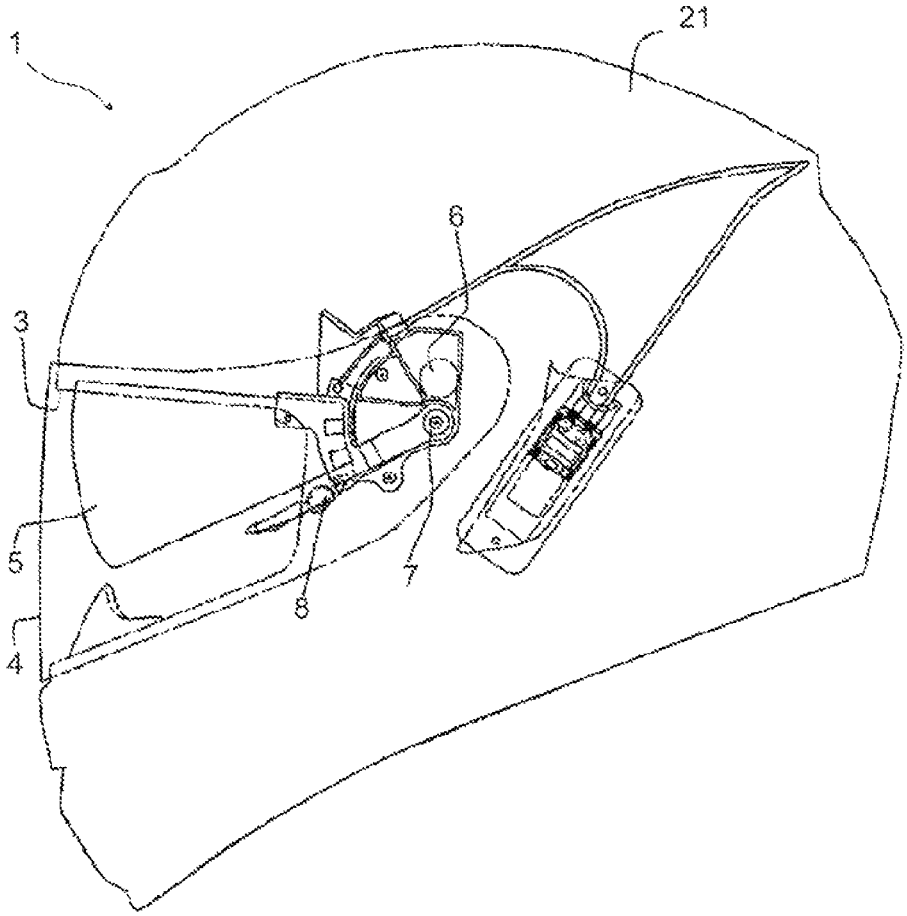
FIG. 2 is a side view of the helmet shown in FIG. 1 and shows a state in which an operation lever has been raised to anchor a holder.
Figure 3:
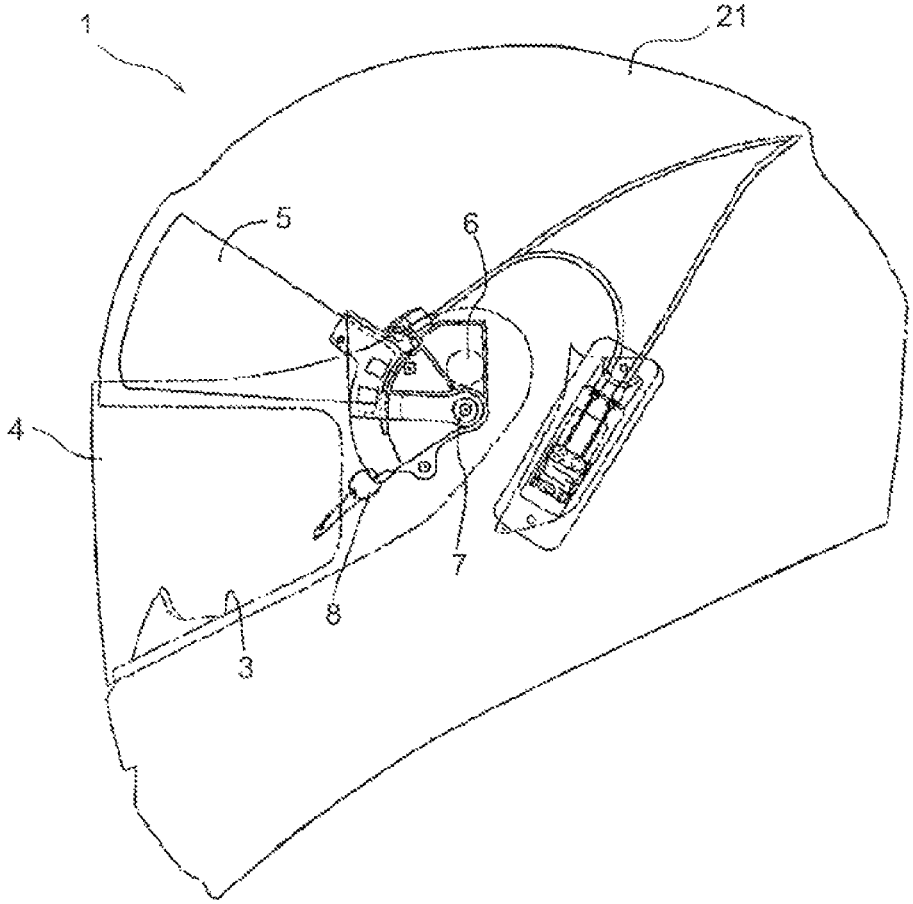
FIG. 3 is a side view of the helmet shown in FIG. 1 and shows a state in which the operation lever has been lowered to open the holder and raise the visor.

As shown in FIG. 1 to FIG. 3, a full-face helmet 1 is equipped with an outer shell 21, which configures an outer peripheral wall of the helmet 1, and a facial opening 3, which is formed opposing the area between the forehead and the chin (i.e., the substantially central portion of the face) of the wearer of the helmet 1, such as a motorcycle rider. Furthermore, the helmet 1 is equipped with an edge member (not shown in the drawings), which is attached to the entire periphery of the facial opening 3, and a shield plate 4, which is configured to open and close substantially the entirety of the facial opening 3 from the outer side of the facial opening 3. Moreover, the helmet 1 is equipped with a visor 5, which is configured to open and close, from the inner side of the facial opening 3, substantially the upper half of the facial opening 3 that opposes the area between the forehead (specifically, the substantially intermediate portion of the forehead in the up and down direction) and the nose (specifically, the substantially intermediate portion of the nose in the up and down direction) of the wearer of the helmet 1, and a locking mechanism 8 for anchoring the visor 5.

The shield plate 4, as is well known, is made from a transparent or translucent material that is flexible, such as polycarbonate or another hard synthetic resin. The shield plate 4 is attached, so as to be reciprocally pivotable, to the outer shell 21 of the helmet 1 by a right and left pair of attachment shaft portions 6 serving as pivotal supporting means on both right and left sides of the helmet 1. The shield plate 4 closes the facial opening 3 in one reciprocal-direction end position (i.e., a down position) thereof and opens the facial opening 3 in the other reciprocal-direction end position (i.e., an up position) thereof.

As shown in FIG. 1 to FIG. 5B, the visor 5, as is well known, is made from a translucent hard material that has a light-blocking function and is flexible, such as polycarbonate or another hard synthetic resin. The visor 5 is provided on the inner side of the outer shell 21 and is held by, in such a way as to be inserted between, a right and left pair of holders 54 that are attached, so as to be reciprocally pivotable, to a right and left pair of attachment shaft portions 7 serving as pivotal supporting means on both right and left sides of the helmet 1. The right and left pair of attachment shaft portions 7 are attached to the outer shell 21 of the helmet 1. In one reciprocal-direction end position (i.e., a down position) of the holders 54, the visor 5 is disposed opposing the area from the forehead to the nose of the wearer of the helmet 1. In the other reciprocal-direction end position (i.e., an up position) of the holders 54, the lower edge of the visor 5 is disposed higher than the upper edge of the facial opening 3 to open the facial opening 3.

2. Configuration of Visor Locking Mechanism

Figure 4A:
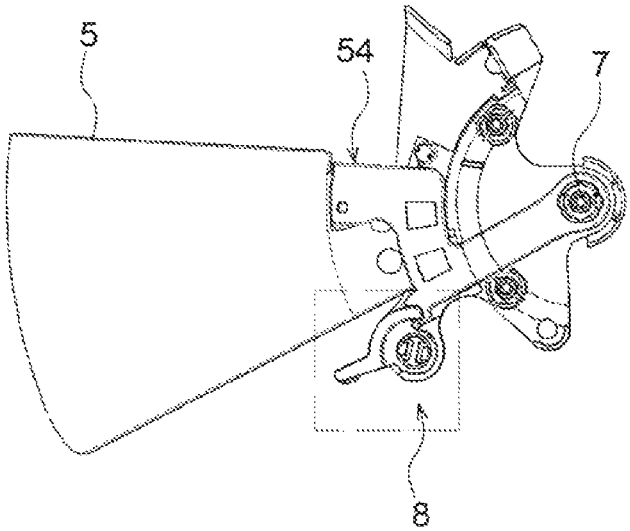
FIG. 4A is a side view showing a state in which pivoting of the holder is being arrested by a lock member.
Figure 4B:
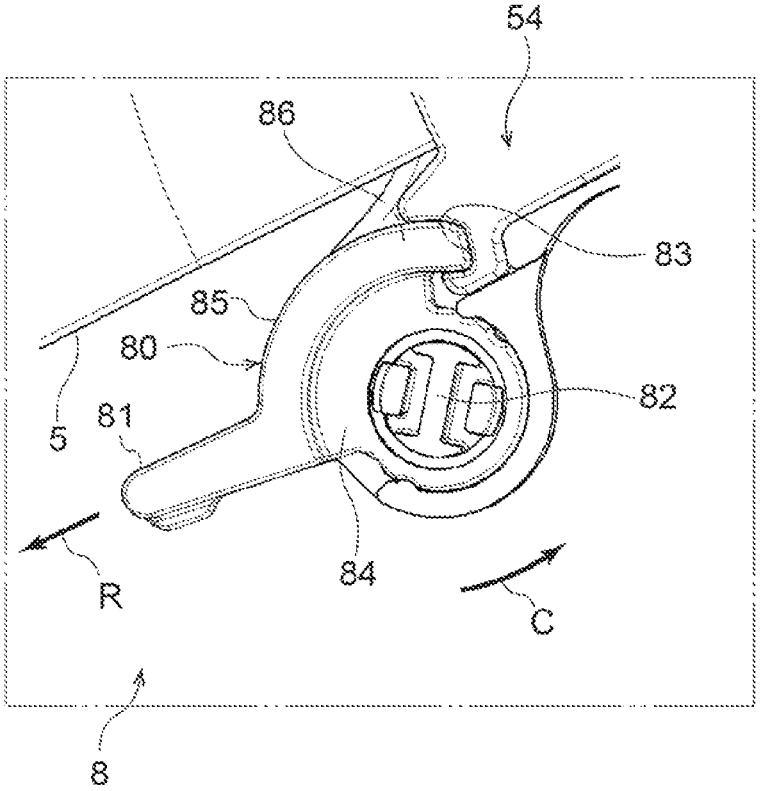
FIG. 4B is an enlarged side view showing the area enclosed by the rectangle defined by the long dashed double-short dashed line shown in FIG. 4A.
Figure 5A:
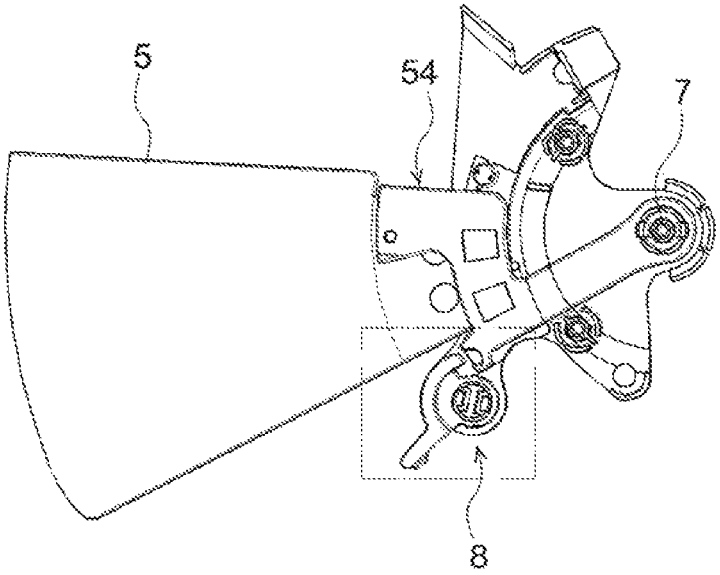
FIG. 5A is a side view showing a state in which pivoting of the holder is not being arrested by the lock member.
Figure 5B:
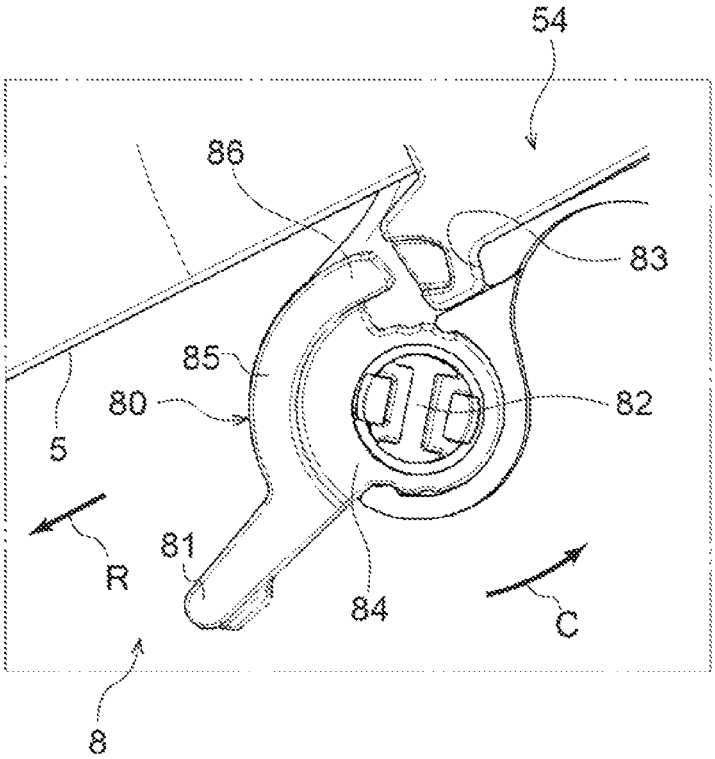
FIG. 5B is an enlarged side view showing the area enclosed by the rectangle defined by the long dashed double-short dashed line shown in FIG. 5A.

As shown in FIG. 4A and FIG. 4B and in FIG. 5A and FIG. 5B, the visor locking mechanism 8 is provided on at least one of the right and left sides of the outer shell 21 (see FIG. 1, etc.). The visor locking mechanism 8 is configured to include a lock member 80 that is installed near the holder 54, a rotating shaft 82 that rotatably supports the lock member 80, and a catch recess portion 83 serving as a catch counterpart portion provided in the holder 54.

The lock member 80 is equipped with a pivotally supported portion 84 that is pivotally supported by the rotating shaft 82 and is formed in the shape of a disc. It will be noted that when the directions "axial direction," "radial direction," and "circumferential direction" are used in the following description, these refer to the "axial direction of rotation," the "radial direction of rotation," and the "circumferential direction of rotation" of the pivotally supported portion 84. Furthermore, arrow R indicates "outward in the radial direction of rotation" and arrow C indicates "one side in the circumferential direction of rotation."

The lock member 80 is equipped with a fan plate portion 85 that projects outward in the radial direction from the pivotally supported portion 84 and is formed in the shape of a fan centered around the rotational center of the pivotally supported portion 84 as seen from the axial direction. Furthermore, the lock member 80 is equipped with an operation lever 81 serving as an operation portion that projects outward in the radial direction from the end portion of the fan plate portion 85 on the one side in the circumferential direction. Moreover, the lock member 80 is equipped with a catch projection 86 serving as a catch portion that projects toward the other side in the circumferential direction from the end portion of the fan plate portion 85 on the other side in the circumferential direction.

The lock member 80 is attached via the rotating shaft 82 to the outer shell 21 (see FIG. 1, etc.) of the helmet 1 on the inner side of the shield plate 4 (see FIG. 1, etc.). In a state in which the lock member 80 is attached to the outer shell 21, the operation lever 81 projects from the facial opening 3 (see FIG. 1, etc.). The operation lever 81 is far from the field of view of the wearer of the helmet 1 and is on the inner side of the shield plate 4, so it is not unintentionally operated. In this way, the operation lever 81 is easily operable. Furthermore, the operation lever 81 does not obstruct the field of view of the wearer of the helmet 1, and the safety of the helmet 1 is not impaired by the operation lever 81.

The catch recess portion 83 provided in the holder 54 is a recessed cavity portion and is disposed opposing the catch projection 86 of the lock member 80 in a state in which the holder 54 is positioned in the one reciprocal-direction end position (i.e., the down position).

As shown in FIG. 4A and FIG. 4B, when the lock member 80 pivots toward the other side in the circumferential direction as a result of the operation lever 81 being operated, the catch projection 86 of the lock member 80 fits into the catch recess portion 83. Because of this, pivoting of the holder 54 is arrested by the lock member 80 and movement of the visor 5 is restricted. In this state, since the visor 5 does not move unintentionally, and the work of detaching the visor 5 from the holder 54 or attaching the visor 5 to the holder 54 can be facilitated. Furthermore, in a state in which pivoting of the holder 54 is being arrested by the lock member 80, the force input to the visor 5 during the work of detaching the visor 5 from the holder 54 or attaching the visor 5 to the holder 54 is received by the lock member 80. That is, the force input to the visor 5 is prevented or inhibited from being input to the mechanism that allows the holder 54 to pivot (move up and down). Because of this, the mechanism that allows the holder 54 to pivot (move up and down) can be prevented or inhibited from sustaining damage during the work of detaching the visor 5 from the holder 54 or attaching the visor 5 to the holder 54.

Figure 6:
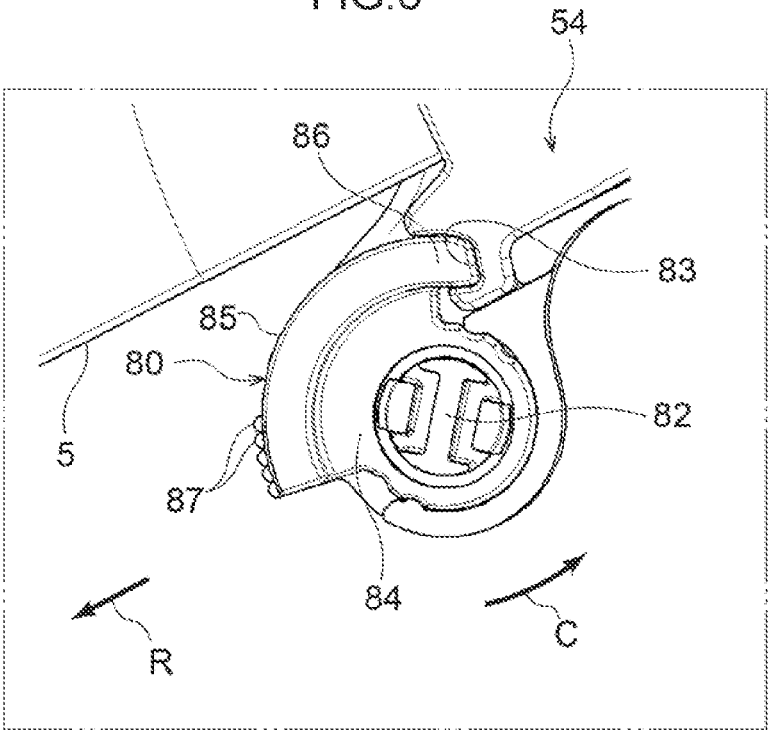
FIG. 6 is an enlarged side view, corresponding to FIG. 4B, showing a configuration where a raised-and-recessed operation portion is provided instead of the operation lever.
Figure 7:
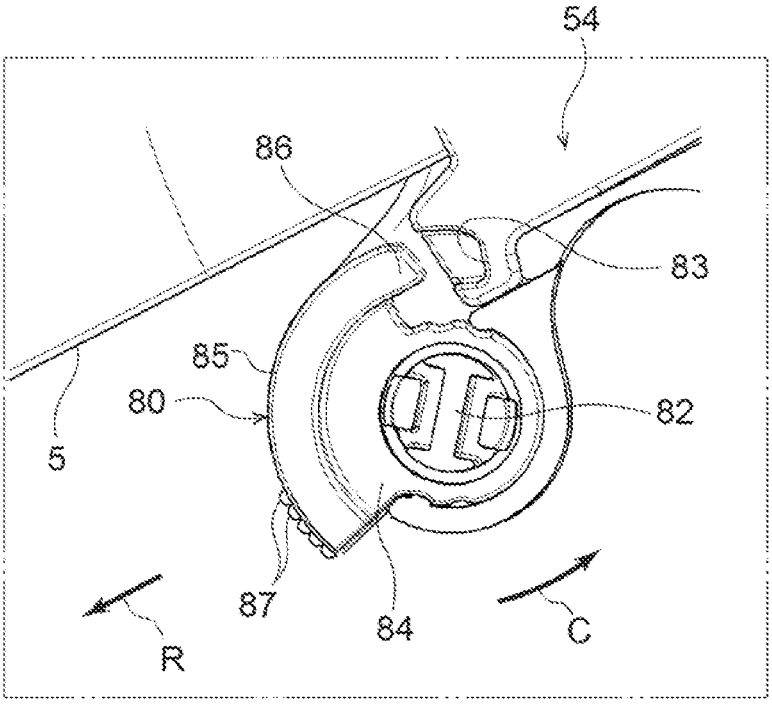
FIG. 7 is an enlarged side view, corresponding to FIG. 5B, showing the configuration where the raised-and-recessed operation portion is provided instead of the operation lever.

Furthermore, in the present embodiment, when applying force to the operation lever 81, a force amplified by the principle of leverage is transmitted to the catch projection 86. Because of this, the catch projection 86 can be easily fitted into the catch recess portion 83. It will be noted that instead of the operation lever 81, a raised-and-recessed operation portion 87 may also be used as shown in FIG. 6 and FIG. 7.

Furthermore, as shown in FIG. 5A and FIG. 5B, when the lock member 80 pivots toward the one side in the circumferential direction as a result of the operation lever 81 being operated, the catch projection 86 of the lock member 80 disengages from (comes out of) the catch recess portion 83. Because of this, pivoting of the holder 54 is allowed and the movement of the visor 5 is allowed.

An embodiment of this disclosure has been described above, but this disclosure is not limited to what is described above and can of course be modified and implemented in a variety of ways, in addition to what is described above, in a range that does not depart from the spirit thereof.

For example, in the above embodiment, this disclosure is applied to a full-face helmet, but this disclosure can also be applied to a flip-up helmet whose chin portion can be flipped up and an open-face helmet that does not have a chin portion.

Furthermore, the visor locking mechanism of this disclosure may be provided on one of the right or left side of the helmet or on both sides.

Furthermore, in the embodiment, an example was described where this disclosure is applied using a movable wire visor as an example, but this disclosure is not limited to this. The visor locking mechanism of this disclosure can be applied as long as there is a part that holds the visor and pivots together with the visor such as the holder. For example, the visor locking mechanism of this disclosure can also be applied to a case where the holders that hold the visor slide along grooves or rails or a case where the holders pivot by means of couplers or gears. Furthermore, according to this disclosure, a locking mechanism resulting from a relatively small number of parts can be configured.

What is claimed is:

1. A helmet comprising:

an outer shell that has a facial opening in a front side of the helmet;

a visor that is provided on an inner side of the outer shell, is attached to a pair of holders, which are pivotably attached to the outer shell, and wherein the visor is configured to close or open at least part of the facial opening; and a visor locking mechanism comprising a lock member, the lock member having an operation portion and a catch portion, the lock member being disposed pivotally near at least one of the pair of holders, the operation portion allowing the catch portion to fit together with or disengage from a catch counterpart portion provided at the at least one of the pair of holders by rotation of the lock member, whereby the visor becomes anchored or released and an axis of the rotation of the lock member being separated from an axis of the rotation of the visor that is provided on at least one of a left side or a right side of the outer shell; and wherein, in a side view of the helmet, the operation portion constantly projects past a side edge of the facial opening and toward a front of the helmet.

2. The visor locking mechanism according to claim 1, wherein: the lock member is equipped with:

a pivotally supported portion that is pivotally supported by a rotating shaft and is formed in the shape of a disc, and a fan plate portion that projects outward in a radial direction from the pivotally supported portion and is formed in the shape of a fan that is centered around a rotational center of the pivotally supported portion as seen from an axial direction;

the operation portion projects outward in the radial direction from a first end portion of the fan plate portion on a first side in a circumferential direction of the fan plate portion; and the catch portion projects toward a second side in the circumferential direction from a second end portion of the fan plate portion.

* * * * *